US008376251B2

(12) United States Patent
Kerns

(10) Patent No.: US 8,376,251 B2
(45) **Date of Patent: *Feb. 19, 2013**

(54) METHOD, SYSTEM AND APPARATUS FOR THE DEAGGLOMERATION AND/OR DISAGGREGATION OF CLUSTERED MATERIALS

(75) Inventor: Kevin C. Kerns, Clarks Summit, PA (US)

(73) Assignee: Minus 100, LLC, Clarks Summit, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/314,479

(22) Filed: Dec. 8, 2011

(65) Prior Publication Data

US 2012/0119000 A1 May 17, 2012

Related U.S. Application Data

(63) Continuation of application No. 12/719,194, filed on Mar. 8, 2010, now Pat. No. 8,091,807, which is a continuation of application No. 11/796,598, filed on Apr. 27, 2007, now Pat. No. 7,690,589.

(60) Provisional application No. 60/796,084, filed on Apr. 28, 2006.

(51) Int. Cl.
*B02C 11/08* (2006.01)
*B02C 21/00* (2006.01)
*B02C 23/00* (2006.01)

(52) U.S. Cl. ..... 241/20; 241/25; 241/79.1; 241/101.78

(58) Field of Classification Search ..... 241/20, 241/21, 25, 101.78, 79.1
See application file for complete search history.

(56) References Cited

U.S. PATENT DOCUMENTS

| | | | | |
|---|---|---|---|---|
| 4,577,804 | A | 3/1986 | Astley et al. | |
| 4,712,742 | A | 12/1987 | Ogawa et al. | |
| 5,979,805 | A * | 11/1999 | Angeletakis | 241/21 |
| 6,010,085 | A * | 1/2000 | Angeletakis | 241/21 |
| 6,066,584 | A | 5/2000 | Krell et al. | |
| 6,412,714 | B1 | 7/2002 | Witsken et al. | |
| 6,451,100 | B1 | 9/2002 | Karl et al. | |
| 6,461,584 | B1 | 10/2002 | Wen et al. | |

(Continued)

FOREIGN PATENT DOCUMENTS

| | | | |
|---|---|---|---|
| EP | 1155735 | A1 | 11/2001 |
| EP | 1688169 | A1 | 8/2006 |

(Continued)

OTHER PUBLICATIONS

R.G. Munro, S.G. Malghan, and S.M. Hsu; Variances in the Measurement of Ceramic Powder Properties; Journal of Research of the national Institute of Standards and Technology, vol. 100, No. 1, Jan.-Feb. 1995, pp. 51-60.

(Continued)

*Primary Examiner* — Bena Miller
(74) *Attorney, Agent, or Firm* — The Webb Law Firm

(57) ABSTRACT

A method of separating at least one cluster of a plurality of clustered particles of a specified material. The method includes: initiating the wetting of at least a portion of the plurality of cluster particles; disaggregating at least a portion of the wetted plurality of cluster particles into a disaggregated material including a plurality of smaller clusters, discrete particles or any combination thereof; and stabilizing at least a portion of the disaggregated material by reducing, eliminating or replacing specified controlling attractive forces. A system and apparatus for separating at least one cluster of a plurality of clustered particles of a specified material are also disclosed.

24 Claims, 13 Drawing Sheets

U.S. PATENT DOCUMENTS

| | | | |
|---|---|---|---|
| 7,105,229 | B2 | 9/2006 | Anderson |
| 7,115,325 | B2 | 10/2006 | Fujimura et al. |
| 7,396,792 | B2 | 7/2008 | Van Bruggen et al. |
| 7,585,360 | B2 | 9/2009 | Fujimura et al. |
| 2005/0228075 | A1 | 10/2005 | Gogos et al. |

FOREIGN PATENT DOCUMENTS

| | | | |
|---|---|---|---|
| GB | 699311 | A | 11/1953 |
| JP | 2000351916 | A | 12/2000 |

OTHER PUBLICATIONS

Roop Chand Bansal, Jean-Baptiste Donnet, and Fritz Stoeckli; Active Carbon; Marcel Dekker, Inc.; Manufacture of Active Carbons; pp. 4-5; 1988.

F. Rouquerol J. Ruquerol & K. Sing; Adsorption by Powders & Porous Solids, Principles, Methodology and Applications; pp. 98-102; 1999.

Philip J. Johnson and David J. Setsuda; Activated Carbon for Automotive Applications; Chapter 8, pp. 235-268; Jul. 1999.

Brady Humiston; General Chemistry, Principles and Structure; Chapter 4, Chemical Bonding: General Concepts; pp. 87-112; 1975.

L.R. Radovic and C. Sudhakar; Introduction to Carbon Technologies Universidad De Alicante, Secretariado de Publicaciones, 1997; pp. 108-113, 183, 184, 211 and 212.

Michio Inagaki; New Carbons, Control of Structure and Functions; Chapter 5, pp. 124-145 and 101; 2000.

Particulate Science and Technology, Chapter 3, Formation and Production of Particulates, 1980.

Simon & Schuster's Guide to Rocks and Minerals, Illustrations 346 for PEAT and 347 for ANTHRACITE; 1977.

Norman L. Weiss, Editor-in-Chief, SME Mineral Processing Handbook, Society of Mining Engineers, 1985, vol. 1, Table of Contents.

Lorenz T. Biegler / Ignacio E. Grossmann / Arthur W. Westerberg, Systematic Methods of Chemical Process Design, Prentice Hall International Series in the Physical and Chemical Engineering Sciences, Chapter 2, Overview of Flowsheet Synthesis, p. 40; Chapter 6, Design and Scheduling of Batch Processes, pp. 180, 200; Chapter 22, Optimal Design and Scheduling of Multiproduct Batch Plants, p. 720; 1997.

Walker, Jr.; Ultrafine Particles, Carbon Black, pp. 300-312; 1963.

Ultra Nanocrystalline Diamond, Synthesis, Properties, and Application, Edited by Olga A. Shenderova and Dieter M. Gruen; Materials Science and Process Technology Series, Gary McGuire—Editor; "Nanocarbon Phase Diagrams", pp. 118-123; "Stability of Small Nanocarbon Particles", pp. 129-130; Chapter 8, "Theoretical Studies of UNCD Synthesis and Properties", by Peter Zapol, Michael Sternberg and Larry A. Curtiss, Argonne National Laboratory, Argonne, IL, USA, Introduction page and p. 274; Chapter 10, On the Discovery of Detonation.

* cited by examiner

| KWh | 0 | 0.0332845 | 0.0665691 | 0.0998536 | 0.1331381 | 0.1664227 | 0.199707 | 0.399414 | 0.465983 | 0.532553 |
|---|---|---|---|---|---|---|---|---|---|---|
| MEAN (nm) | 33.9 | 26.7 | 24.6 | 23.6 | 21.8 | 21.0 | 20.6 | 19.9 | 19.9 | 18.7 |

METHOD, SYSTEM AND APPARATUS FOR THE DEAGGLOMERATION AND/OR DISAGGREGATION OF CLUSTERED MATERIALS

This application is a continuation of U.S. patent application Ser. No. 12/719,194, filed Mar. 8, 2010, which is a continuation of U.S. patent application Ser. No. 11/796,598, filed Apr. 27, 2007 (issued on Apr. 6, 2010 as U.S. Pat. No. 7,690,589); which claims benefit of priority of U.S. Provisional Patent Application Ser. No. 60/796,084, filed Apr. 28, 2006, which is incorporated herein by reference in its entirety.

BACKGROUND OF THE INVENTION

1. Field of the Invention

The present invention relates generally to various chemical and/or mechanical processes for the deagglomeration, disaggregation and/or grinding of various materials, in particular, the present invention relates to the chemical-mechanical deagglomeration and/or disaggregation of specified materials, which results in the separation of clustered particles of specified materials, such as ultra-dispersed diamond (UDD), ultra-nano crystalline diamond (UNCD), various carbon materials, including coal and the like, and other aggregated and/or agglomerated ultra-fine powders, such as single metal oxides, complex metal oxides, coated powders and the like.

2. Description of Related Art

Powdered material, fine particulate material, micrometer-sized particles, nanometer-sized particles and similar materials are now being used in a variety of specialty applications. For example, such materials are used in precision polishing processes, chemical mechanical planarization (CMP), fuel cell applications, oxygen generation, biotechnology processes, petrochemical processes, chemical processes, transportation applications, performance material sectors, etc. However, in order to be useful in these specialty applications, such powders need to be refined and provided in usable forms, such that end-use manufacturers are able to obtain high quality powders at a reasonable cost. Accordingly, there is a need for a process capable of providing such materials to manufacturers in various industries, including electronics, energy generation, environmental control, petrochemical and chemical industries.

As discussed, due to the application in such specialized industries, greater process performances are required to meet tighter specifications and satisfy the increasing demands of high quality powders. Attaining such tight specifications requires improving the control over the particle material properties. Dependent upon the type of materials to be produced, each has various drawbacks and requires the production of pure powdered particulate matter. For example, some of these materials may include UDD, UNCD, carbon materials, coal, single oxide powders, complex metal oxide powders, coated particles, etc.

All of these small-particulate materials tend to form aggregates, agglomerates and/or flocculates during the manufacturing process. Specifically, either during the formation process and/or during subsequent processing, aggregates or clusters form, which are composed of individual particles held together by relatively weak bonds, causing a cohesive force and formation of such clusters. In order to maximize the physical and chemical characteristics of these powders, it is desirable to overcome these cohesive forces, which results in discrete particulates and/or reduced cluster sizes.

Single metal oxides have a wide range of industrial applications, including use as a polishing material, a catalyst support material, pigment, ultraviolet blocker, etc. Non-mined ceramic powders are typically prepared by isolating the metal of interest as a compound or metal, and then reacting to the material to form the desired compound. For the production of aluminum oxide, one typically used process is the "BAYER" process, where aluminum is separated to the compound aluminum hydroxide through a digestion and precipitation step performed on gibbsite. The aluminum hydroxide is then heated to 1050° C. to decompose the hydroxyl ions and form $Al_2O_3$ and $H_2O$. A final step in this process is the grinding of the $Al_2O_3$ to obtain the desired particle size. Further, $Al_2O_3$ can be prepared as either transition alumina or alpha alumina, which are differentiated by crystalline structure. The high surface areas and a lower hardness of the transition alumina are utilized in the catalyst and polishing of semiconductors. One drawback of the above-described method for the production of single metal oxide powders is the requirement for reducing the particle size through a milling step. Additional technical barriers associated with this process include a minimum size limit to which particles can effectively be reduced (approximately 500 nm), a broad particle size distribution and a substantial energy and equipment requirement for milling.

With respect to complex metal oxides, which is an oxide compound containing more than one metal, such compounds (e.g., $BaTiO_3$) and solid solutions include a metal oxide uniformly dispersed through a structure of another oxide, such as $Y_2O_3$ stabilized $ZrO_2$ (YSZ). Currently, complex metal oxides and solid solutions of metal oxides are produced through solid state reactions, crystallization of melts and solution methods.

In the solid state reaction methods, compounds containing the metals of interest are combined, thoroughly mixed and then fired. During the firing process, the precursor compounds break down into the oxides of the individual metals. The metal ions then diffuse together to produce the compound containing both metals. This diffusion process tends to be slow, and therefore, the material is cooled and re-ground to create fresh surfaces for the individual metal oxides to interact, and produce more of the desired compound during subsequent re-firing. This cooling, grinding and re-firing process may be repeated three or four times to achieve the desired level of homogeneity and conversion to the final product. Some primary technical limitations of this process include the formation of secondary phases, incomplete reaction of the precursor materials, the growth of large particles and agglomerates during the extended firing process and the high energy requirements for re-firing the material and grinding. An additional deficiency is the limit on the minimal particle size from the milling process.

One method of overcoming such limitations with the solid state reaction method of producing complex metal oxides is through wet chemistry methods. In these methods, compounds containing the metals of interest are dissolved in a solution, the water quickly removed from the solution (or the solution is gelled), and the resulting solid or gel is heated. Combining the metal ions in a solution provides a method for intimately mixing the different metal ions on an atomic level. Quickly removing the water or gelling solution stabilizes the high degree of mixing between the metal ions achieved in the solution. The heating of the de-watered solution or gel in the presence of oxygen results in the formation of oxide compounds. Such wet chemistry methods, while successful in a laboratory, appear to be difficult to scale up to a pilot level operation, which is an obvious technical limitation. Additionally, there are difficulties with obtaining the resource materials exhibiting consistent properties utilizing these methods.

Some manufacturers are no longer involved in the production of such materials due to these difficulties.

One variation of the wet chemistry method is the flame-spray method of producing oxides. In this method, the solution prepared is atomized and passed through a flame. When the droplets pass through the flame, the liquid in the solution is rapidly vaporized and the reactions to convert the dried substance to an oxide occur. In flame spray technologies, particle size control limitations arise from variations in the time-temperature history encountered as the particles pass through the flame. An additional concern with the flame spray technology is that as the particles pass through the high temperature regions of the flame, the oxides may be preferentially volatilized leading to the segregation of the metal ions. This potentially results in not obtaining the desired composition in the final product, and in a non-uniform chemical composition throughout this final product.

Another type of material in this general application is referred to as coated particles. Coated particles may be made when a coating oxide/material wets the oxide surface of the primary particle. For example, the catalytic behavior of $V_2O_5$ when applied to $TiO_2$ for alcohol conversion to aldehydes is greatly improved through coating the $V_2O_5$ onto the surface of $TiO_2$. Coated particles are produced through a wet incipient process. In the wet incipient process, particles are saturated with a solution containing the metal of interest. The powder is then dried and heat-treated to convert the metal by the oxide or metal and solution, such that the solution oxide/metal will form a continuous coating on the particle surface. Some technical barriers associated with these coated particles are the requirement of a two-step process, as well as the potential for the coating to bridge between the particles, thereby forming agglomerates. In addition, this two-step process leads to an effective doubling of the energy required to produce the final particles.

Ultra-Dispersed Diamond (UDD) or Ultra-Nano Crystalline Diamond (UNCD) are the synthetic diamonds found by the detonation synthesis method resulting in a relatively narrow size distribution, which is also characteristic of diamond particles found in meteorites and protoplanetary nebulae. UDD or Nano Diamonds, also known as nanocrystalline diamonds, have been commercially available for many years. Applications for these materials include, but are not limited to: electrodeposition, polymer composition, films and membranes, radiation and ozone-resistant coatings, lubricating oils, greases and lubricating coolants, abrasive tools, polishing pastes and polishing suspensions for hard-disk drives, optical, semi-conductor component, chemical mechanical planarization, etc. Due to the UDD's biocompatibility, these materials have potential uses in a variety of biological and medical applications. Additional areas of application include fuel cells, magnetic recording systems, catalysts, sintering, advanced material composites, new materials, etc.

Another type of material contemplated by the present application is anthracite or coal. Coal is composed of a complex, heterogeneous mixture of organic and inorganic components that vary in shape, size and composition depending upon the nature of the vegetation from which they were derived, the environment in which they were deposited and the chemical and physical processes that occurred after burial. Finely sized or polarized anthracite and other coals are being used in fuel and non-fuel applications, including applications that use these coal materials as pre-cursor particles for the production of high value added carbon products. These carbon products, however, have minimal or no requirements directed to the exact physical and chemical properties, such as: particle size, particle distribution, particle shape, specific surface area, and bulk purity. Many of these application needs have been met with little or no success according to the prior art.

Normally, such ultra-fine powders, including UDD, during production or processing, form aggregate/agglomerates, commonly referred to as "clusters". In particular, either during the formation process and/or subsequent processing steps, aggregates form, made up of individual particles held together by relatively weak bonds or material bridging, as discussed above. In order to maximize the nano diamonds and other nano-sized particles potential in the aforementioned applications, one must overcome these cohesive forces resulting in discrete particulates or reduced cluster sizes. In processing of micrometer-sized and nanometer-sized coal particles, this is commonly referred to as particle accretion.

SUMMARY OF THE INVENTION

It is, therefore, one object of the present invention to provide a method, system and apparatus for the deagglomeration and/or disaggregation of various clustered materials that overcome the drawbacks and deficiencies of prior art methods and processes. It is a further object of the present invention to provide a method, system and apparatus for the deagglomeration and/or disaggregation of various clustered materials that separate the clustered material into discrete particles and/or smaller clusters. It is yet another object of the present invention to provide a method, system and apparatus for the deagglomeration and/or disaggregation of various clustered materials that provide a useful end product to manufacturers in various specialty applications and industries.

The present invention is directed to a method of separating at least one cluster of a plurality of cluster particles of a specified material. This method includes: (a) initiating the wetting of at least a portion of the plurality of clustered particles; (b) disaggregating at least a portion of the wetted plurality of clustered particles into a disaggregated material comprising a plurality of smaller clusters, discrete particles or any combination thereof; and (c) stabilizing at least a portion of the disaggregated material by reducing or eliminating specified controlling attractive forces.

The present invention is further directed to a system for separating at least one cluster of a plurality of cluster particles of a specified material. The system includes means for initiating the wetting of at least a portion of the plurality of cluster particles, and means for disaggregating at least a portion of the wetted plurality of clustered particles into a disaggregated material. The disaggregated material includes a plurality of smaller clusters and/or discrete particles. The system also includes means for stabilizing at least a portion of the disaggregated material by reducing, eliminating or replacing specified controlling attractive forces.

In a further aspect, the present invention is directed to an apparatus for separating at least one cluster of a plurality of cluster particles of a specified material. This apparatus includes a mixing device for receiving and mixing the specified material and at least one liquid material, thereby providing a mixed material including a plurality of at least partially wetted, clustered particles. The apparatus further includes a disaggregation device for receiving and disaggregating at least a portion of the mixed material, thereby providing a disaggregated material. A stabilization device receives and stabilizes at least a portion of the disaggregated material.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DESCRIPTION OF THE PREFERRED EMBODIMENTS

Figure 1:
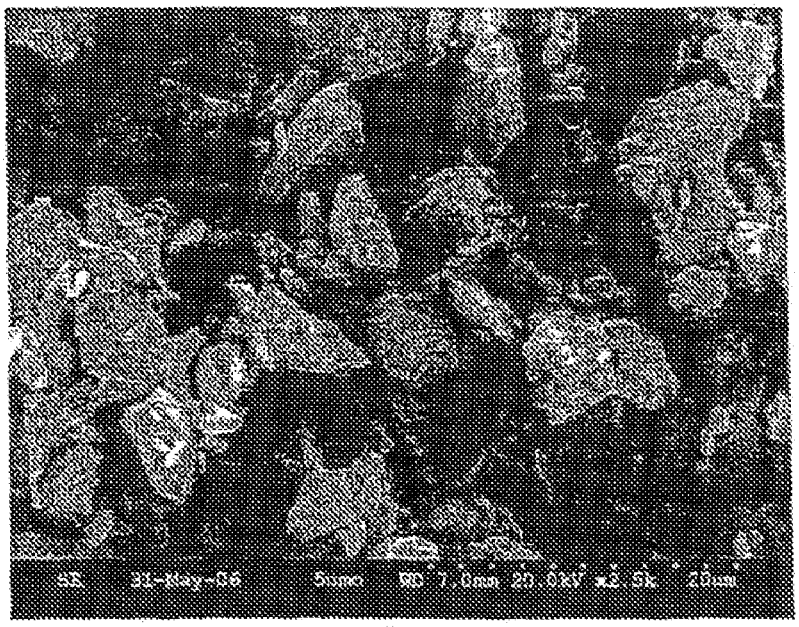
Fig. 1 (Prior Art)
FIG. 1 is an SEM of 0-10 micron coal particles made in accordance with the prior art.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

It is to be understood that the invention may assume various alternative variations and step sequences, except where expressly specified to the contrary. It is also to be understood that the specific devices and processes illustrated in the attached drawings, and described in the following specification, are simply exemplary embodiments of the invention.

The presently-invented method, system and apparatus effectively separate clustered particles of a specified material into discrete particles and/or smaller clusters. As used herein, this process may be referred to as a separation process, a disaggregation process, a disagglomeration process or other similar terms and processes reflective of transforming clustered particles into discrete particulate material and/or smaller clustered particles. In addition, the presently-invented method, system and apparatus is useful in connection with a variety of materials, as discussed above. For example, the material subjected to this method and process may be a powdered material, an oxide, a single-metal oxide, a complex-metal oxide, a coated particle, ultra-dispersed diamond, ultra-nano crystalline diamond, an aggregated material, an agglomerated material, a flocculated material, anthracite, coal, a carbon-based material, a micrometer-sized material, a nanometer-sized material, etc. Specifically, the method, system and apparatus of the present invention is useful in connection with any type of material in a particulate form, where the particles tend to cluster, aggregate or agglomerate due to the above-discussed cohesive forces. As discussed, it is one object of the present invention to overcome these cohesive forces and separate the materials into smaller clusters or discrete particles.

Figure 2:
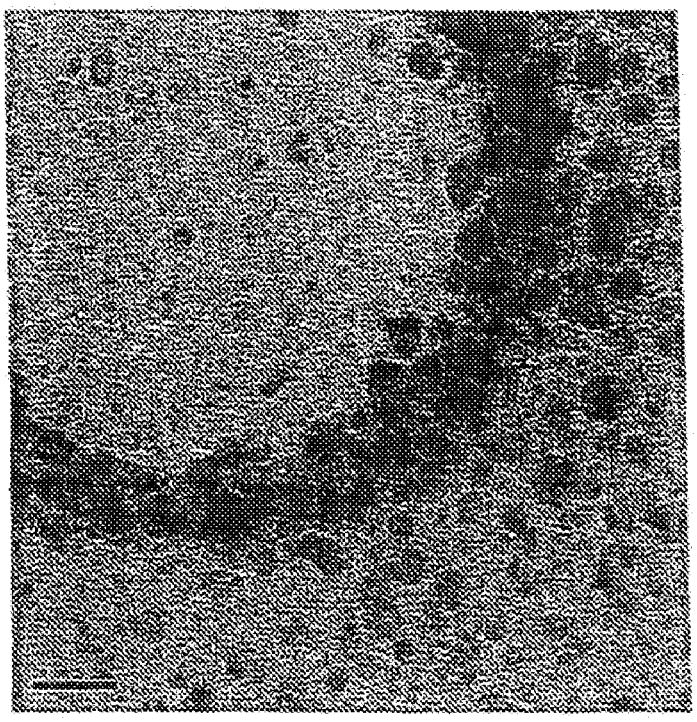
FIG. 2 is an HRTEM of the coal particles of FIG. 1 after being processed according to the present invention.

In one example, the specified materials subjected to the method, system and apparatus of the present invention is coal. As seen in FIG. 1, a SEM of existing coal particles is shown. These particles range in size between 0 and 10 microns, with an average particle size of approximately 6 microns. This demonstrates the clustered nature of such particles prior to subjection to the presently-invented method, system and apparatus. According to the prior art, as these particles are ground to sub-micron particle sizes, they tend to accrete (recombine to form larger particles, due to plastic deformation and certain controlling attractive/adhesive forces). As referred to herein, this accretion is similar to the aggregation, agglomeration and/or clustering at the sub-micron and nanoscale level. This accretion will be avoided or reduced by subjecting the sub-micron coal particles to the presently-invented method, system and apparatus, which results in an end product comprising nanometer-sized coal particles. After processing (as discussed in detail below), the individual particles are illustrated in FIG. 2. Specifically, FIG. 2 is an HRTM of this nano-ground coal now exhibiting a particle size of approximately 6 nanometers. The product illustrated in FIG. 2 is the result of processing using the presently-invented method, system and apparatus. As demonstrated, a size reduction of over three orders of magnitude has been obtained.

Figure 3:
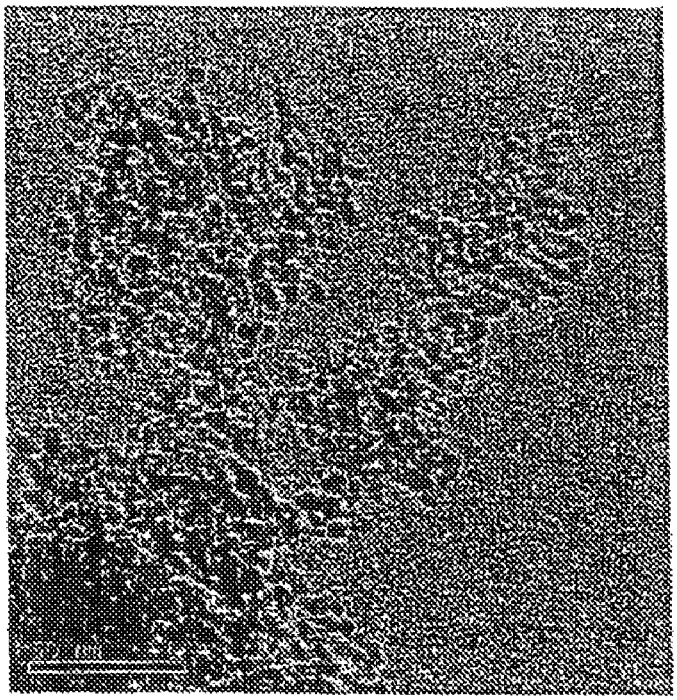
Fig. 3 (Prior Art)
FIG. 3 is a TEM of raw UNCD material according to the prior art.
Figure 4:
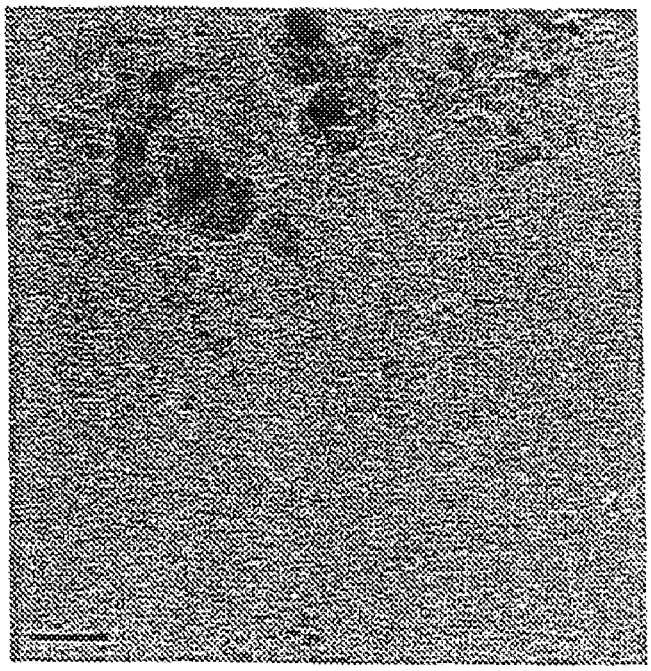
FIG. 4 is a TEM of the UNCD particles of FIG. 3 after being processed according to the present invention.

As another example of the benefits and resulting product of the present invention, FIGS. 3 and 4 illustrate the use of an ultra-dispersed diamond material. In particular, FIG. 3 is a TEM of raw Ultra-Nano Crystalline Diamond (UNCD) material that exhibits aggregates or clusters of approximately 400 nanometers in size. After processing according to the present invention, the resultant material is illustrated in FIG. 4, which is a TEM of these particles disaggregated into the primary particle status. Further, this resulting product evidences particles of approximately 12 nanometers in size.

Therefore, as illustrated above and in FIGS. 1-4, the presently-invented method effectively separates clustered particles of a specified material into discrete particles and/or smaller clusters, which may then be used in the specialized applications discussed above. In particular, the method of the present invention includes wetting at least a portion of the clustered particles, and disaggregating at least a portion of these wetted clustered particles into a disaggregated material, which would include smaller clusters and/or discrete particles of the specified material. Next, the disaggregated material must be stabilized, which reduces, eliminates or replaces specified controlling attractive forces between the particles and surface. Once stabilized, the final product is obtained, as shown above in the examples in FIGS. 2 and 4.

This final product may be further processed to provide an even more useful product by separating this wetted, disaggregated and stabilized material into one or more specified particle size ranges or distributions. This allows the finally-produced product to be specifically tailored to meet a user's needs by exhibiting a tailored, known and narrow particle size range or distribution.

Figure 5:
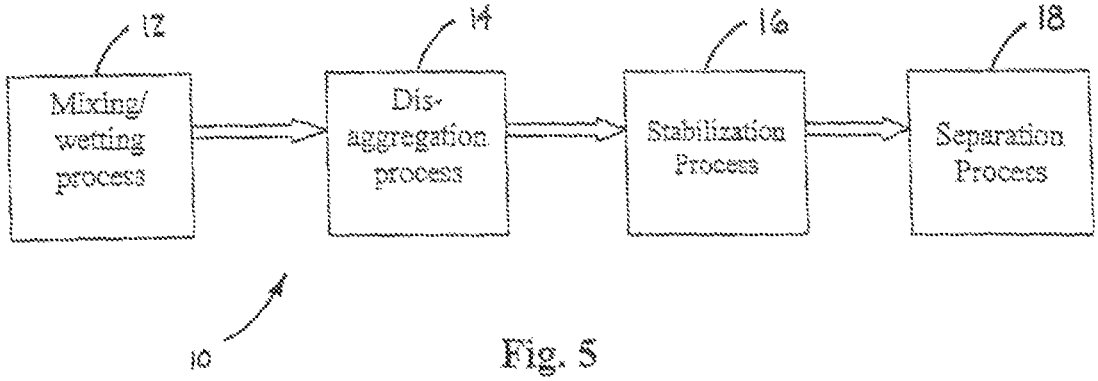
FIG. 5 is a schematic view of one embodiment of a method and system according to the present invention.

One embodiment of the presently-invented process 10 is illustrated in schematic form in FIG. 5. In particular, in this embodiment, the process 10 includes a mixing/wetting process 12, a disaggregation process 14, a stabilization process 16 and a separation process 18. Each of these various subprocesses 12, 14, 16, 18 will be discussed in greater detail below. However, by using these processes, 12, 14, 16, 18, a final product is provided, where the clustered particles have been disaggregated and stabilized, as well as further tailored to provide a desired particle size distribution or range.

Each of the processes described above are used to transform the material from the clustered state to the finally-tailored product state. Specifically, the mixing/wetting process 12 initiates the wetting of the clustered particles in the transformation from a dry or solid-based system to a solid/liquid-based system. The disaggregation process 14 is used to disaggregate, deagglomerate or otherwise separate these clusters into discrete particles or smaller clusters. In this manner, reduced cluster sizes or discrete particle liberation is attained. Next, in the stabilization process 16, the disaggregated material is diluted and subject to dispersion stabilization. In this manner, the final chemical characteristics are acquired and particle size distribution clarity is attained. Finally, in the optional separation process 18, particle size distribution modification is achieved, as well as elimination of oversized clusters or aggregates.

Accordingly, the process 10 of the present invention may be referred to as a separation or dispersion process, which includes the wetting step, particle separation and particle stabilization. In one example, the particles of UDD and other ultra-fine powders must be dispersed to its primary particle size in order to develop its fullest potential. It is also advantageous to control the cluster size for a full range of performance potential. With respect to coal, even though it is an inhomogeneous material, made up of various sources of carbon, it still acts as a soft aggregate during the nano-grinding process. Further, fragments caused by the introduction of grinding energy need also to be dispersed to its primary particle size in order to further ground.

With respect to the wetting process 12, the clustered particles, i.e., the starting material, is distributed in a liquid system, where some liquid material is spread over the surface of the solid particulate surface. The liquid is referred to as the "solvent" component of the liquid system, which is normally comprised of a base solvent, as well as some wetting and/or dispersing agent, e.g., hyper-dispersants, etc. Other synergistic material may also be used, which are specialized chemicals that beneficially interact with a dispersant, and function as a dispersant aid at the liquid-solid interface. The liquid system may be formed of a variety of liquid materials, including, but not limited to, a base solvent, water, oil, a wetting agent, a dispersant agent (e.g., dissolved solids), a material dissolve solvents, a hyper-dispersant material, a synergistic material, a polar material, a non-polar material, etc. In one example, three different liquid systems were used—two polar and one non-polar. Further, three wetting/dispersant agents were selected, one for each of the systems. A solids weight of ≧25% was initially tested per liquid system.

It should be noted that, in this mixing/wetting process 12, the "wetting" of the clustered or aggregated particles is initiated. In some instances, the complete "wetting" of the materials occurs throughout the process 10, such as during a pre-mixing, wetting and/or disaggregation process. Due to the physical principles of "wetting" a material, and transforming the system from a solid system to a solid/liquid system, this process may occur in connection with other steps and processes described herein.

One optional step of the mixing/wetting process 12 is the mixing of the clustered particles, which provides some initial separation, as augmented or facilitated by the wetting of the particles and introduction of sufficient forces to the solution, which affect the solids contained therein. Flocculates are loosely packed particles, which form after the "empty spaces" in between the agglomerated particles have had air or moisture replaced with the base solution. With additional application of forces, these flocculates can then disintegrate, resulting in a discrete particle population. While, in some instances, it may be advantageous to interrupt the separation of particles at the flocculated stage, in order to break up these flocculated particles, the cohesive strength must be overcome. With the addition of appropriate forces, the particles may be peeled from the larger mass, which may be accomplished using a mixing/milling process, and/or a mixing/milling/sonic radiation process (as discussed below). Accordingly, the process 10 of the present invention uses both mechanical mixing and milling steps, as well as complimentary chemistries, in order to provide a delivery vehicle for the base solution with its dispersant to the particle surface within the agglomerate. Such chemistries, plus sufficient shearing and impacting, provide the resultant flocculate, cluster size, aggregate or discrete particle population.

Figure 6:
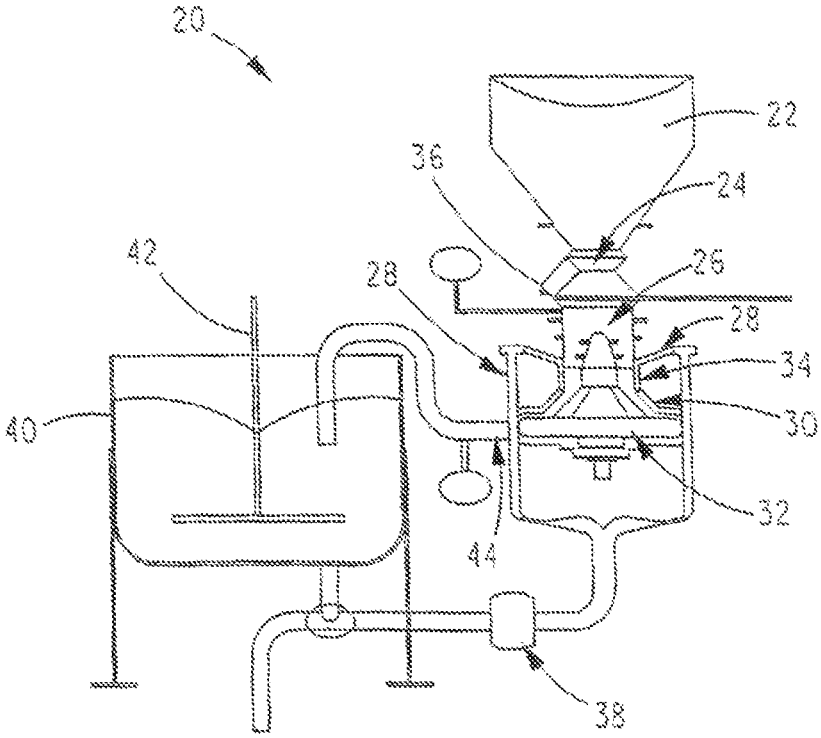
FIG. 6 is a schematic view of a mixing apparatus that can be used in connection with the method and system according to the present invention.

As discussed, the wetting process and the mixing process may be combined into the mixing/wetting process 12. In addition, this mixing process may be accomplished using vacuum mixing, an agitation process, etc. In addition, this mixing process may be considered a pre-mixing step, where the air between the agglomerated particles is evacuated and replaced by the base solution. One example of a mixing apparatus 20 that can be used in the mixing/wetting process 12 is illustrated in FIG. 6. As illustrated, the material is placed in a hopper 22 and fed through a rotary valve 24. This material then contacts a disintegrator 26, connected to a rotor. Next, the liquid material is tangentially injected through one or more entry conduits 28 into an acceleration chamber 30. In this manner, the solid particulate is "wetted". In addition, the mixing apparatus 20 in this embodiment of the mixing/wetting process 12 utilizes a cyclone 34 in a cone-shaped compression zone having a cooled housing 32. It should be further noted that the acceleration chamber 30 is intersected by a safety slide valve 36. In addition, in order to provide the liquid material through the entry conduits 28, a wetting stream pump 38 is provided. After this wetting and pre-mixing process, the material is directed to a batch tank 40 having an agitator 42. As seen in FIG. 6, the material that includes larger clusters or larger particulate matter near the top of the batch tank 40 is removed and re-circulated through conduit 44. In this manner, the mixing/wetting process 12 (and the mixing apparatus 20) initiates "wetting" and mixes the particulate matter, thereby transforming the material from a solid system to a solid/liquid system.

Figure 7:
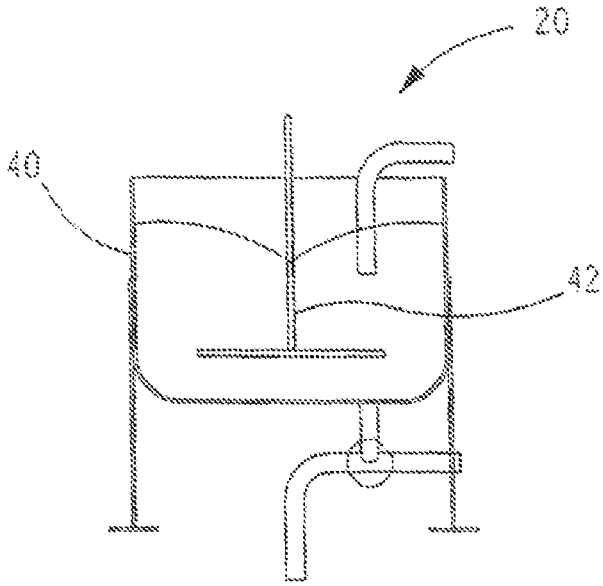
FIG. 7 is a schematic view of a further mixing apparatus that can be used in connection with the method and system according to the present invention.
Figure 8:
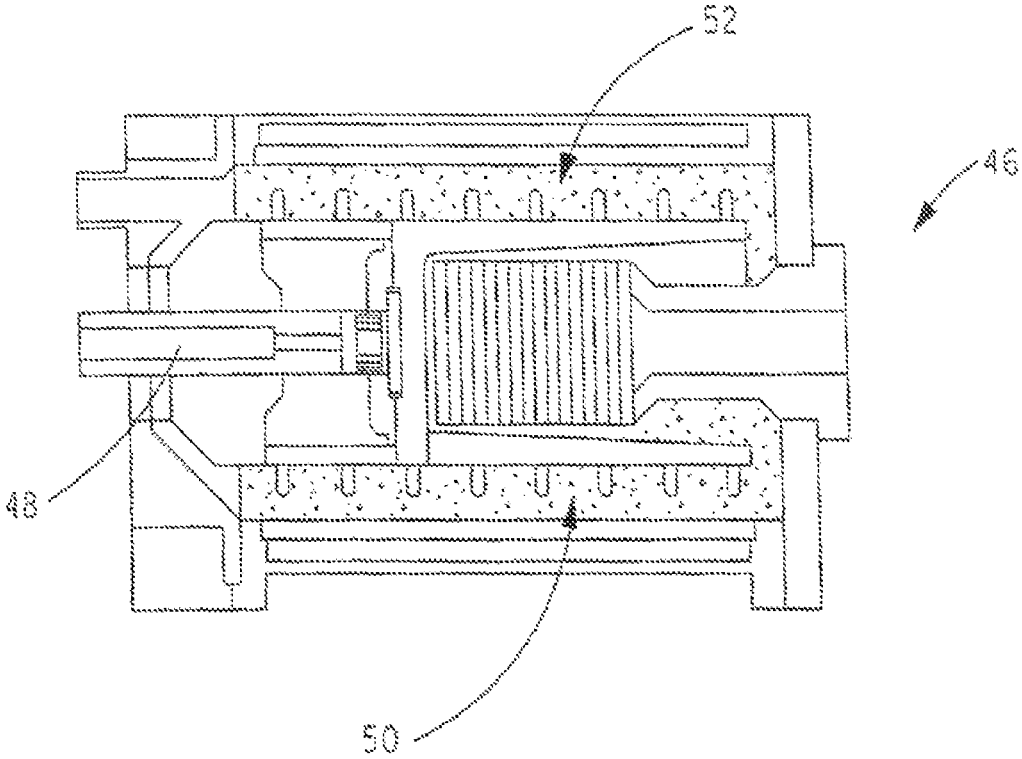
FIG. 8 is a schematic view of a disaggregation apparatus that can be used in connection with the method and system according to the present invention.

In another embodiment, and as illustrated in FIG. 7, the mixing/wetting process 12 may include a mixing apparatus 20 that simply includes the batch tank 40 and agitator 42. In particular, the pre-mixing and other extra components and steps discussed above are optional, and only lead to a better mixing and wetting procedure. In any case, the mixing or pre-wetting of the specified material is optional, and it is only the "wetting" process that is required in transforming the material from a solid state to a solid/liquid or slurry state. After the mixing/wetting process 12, the particles and solution are introduced to the disaggregation process 14, i.e., subjected to shearing and impacting forces supplied by some disaggregation apparatus 46. In one embodiment, the disaggregation apparatus 46 is a high-energy bead mill that includes the appropriate grinding media. Specifically, as illustrated in FIG. 8, this disaggregation apparatus 46 is a high-energy agitator bead mill, which grinds the wetted material using an agitator shaft 48. This causes or implements shearing and impacting forces upon the wetted material. Further, rotation of the agitator shaft 48 imparts energy to the grinding media 50 with a specific density, size and composition. Further, the agitator shaft 48 permits the grinding media 50 to exhibit the appropriate forces to act upon the solid suspended in the base solution (with or without the wetting and/or dispersing agents).

The forces imparted by the grinding media 50 tear at and crush the aggregates, agglomerates and/or clusters of particulates as they pass through a grinding chamber 52, which results in a smaller aggregate/agglomerate/cluster size, or an entirely discrete particle population (or some combination thereof). The use of various physical parameters, including temperature, material flow, grinding media, agitator speed, etc. are process parameters that may be adjusted in order to achieve the appropriate separation or disaggregation of material. In this manner, specifically-designed chemistries, coupled with the shearing and impacting forces provided by the mixing apparatus 20 and/or the disaggregation apparatus 46, yield a product exhibiting a reduced cluster size, or in some instances, a discrete particle population.

Figure 9:
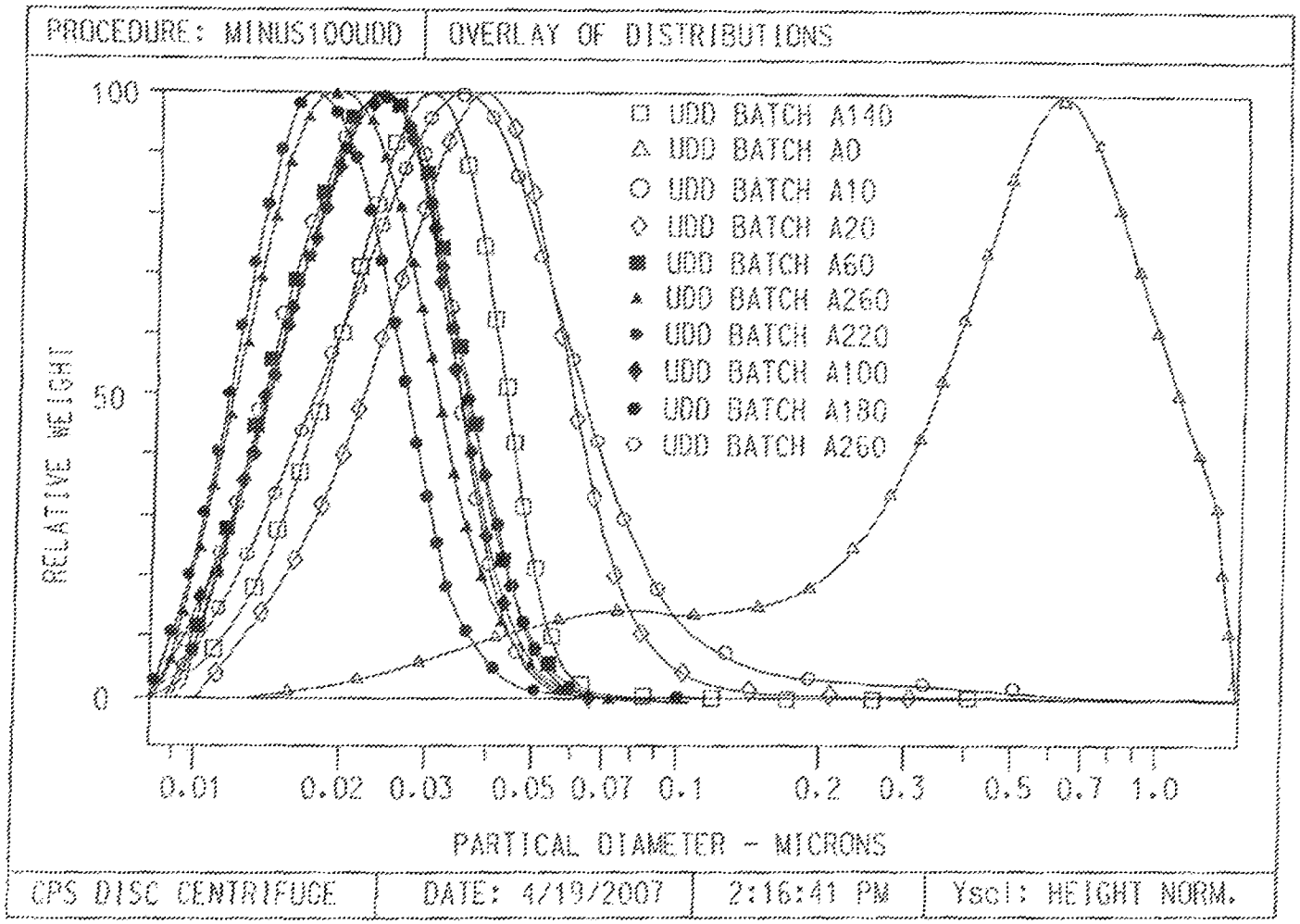
FIG. 9 is a chart/graph illustrating particle size distribution after a specific mill cycle time of a product produced according to the present invention.

One example of a UDD material that has been subjected to the mixing/wetting process 12 and disaggregation process 14 (Experiment A) is illustrated in Table 1. Specifically, Table 1 compares the particle size diameter of the UDD material over the process cycle time. In addition, the results of this processing of the UDD material is illustrated in graphical form in FIG. 9.

TABLE 1

DISAGGREGATION PSD COMPARISON
UDD - Experiment A

| Product Designation | | | Statistics (micron) | | | Particle Distribution (micron) | | | | | | | | |
|---|---|---|---|---|---|---|---|---|---|---|---|---|---|---|
| Size (micron) | ID | Cycle Time | Mean | Std Dev | Mean:Median Ratio | <1% | <5% | <10% | <25% | <50% | <75% | <90% | <95% | <99% |
| UDD | Water Soluble | 0 min | 0.5389 | 0.2863 | 1.050897 | 1.3101 | 1.1518 | 1.0403 | 0.7512 | 0.5128 | 0.2939 | 0.0917 | 0.0532 | 0.0265 |
| UDD | Water Soluble | 10 min | 0.0462 | 0.1562 | 1.3668639 | 0.3169 | 0.0999 | 0.0729 | 0.0494 | 0.0338 | 0.0232 | 0.0166 | 0.0139 | 0.0107 |
| UDD | Water Soluble | 20 min | 0.0409 | 0.1462 | 1.1488764 | 0.1204 | 0.0721 | 0.0610 | 0.0473 | 0.0356 | 0.0261 | 0.0193 | 0.0163 | 0.0126 |
| UDD | Water Soluble | 60 min | 0.0241 | 0.0765 | 1.0758928 | 0.0534 | 0.0410 | 0.0360 | 0.0289 | 0.0224 | 0.0170 | 0.0134 | 0.0117 | 0.0097 |
| UDD | Water Soluble | 100 min | 0.0233 | 0.0470 | 1.0590909 | 0.0483 | 0.0387 | 0.0344 | 0.0281 | 0.0220 | 0.0170 | 0.0136 | 0.0120 | 0.0102 |
| UDD | Water Soluble | 140 min | 0.0292 | 0.1375 | 1.057971 | 0.0552 | 0.0465 | 0.0420 | 0.0349 | 0.0276 | 0.0212 | 0.0167 | 0.0146 | 0.0120 |
| UDD | Water Soluble | 180 min | 0.0243 | 0.1539 | 1.0848214 | 0.0497 | 0.0406 | 0.0359 | 0.0288 | 0.0224 | 0.0172 | 0.0138 | 0.0123 | 0.0104 |
| UDD | Water Soluble | 220 min | 0.0192 | 0.1548 | 1.0971428 | 0.0403 | 0.0311 | 0.0275 | 0.0222 | 0.0175 | 0.0140 | 0.0117 | 0.0107 | 0.0092 |
| UDD | Water Soluble | 260 min | 0.0209 | 0.0107 | 1.0829015 | 0.0465 | 0.0364 | 0.0317 | 0.0251 | 0.0193 | 0.0149 | 0.0122 | 0.0110 | 0.0095 |

Figure 10:
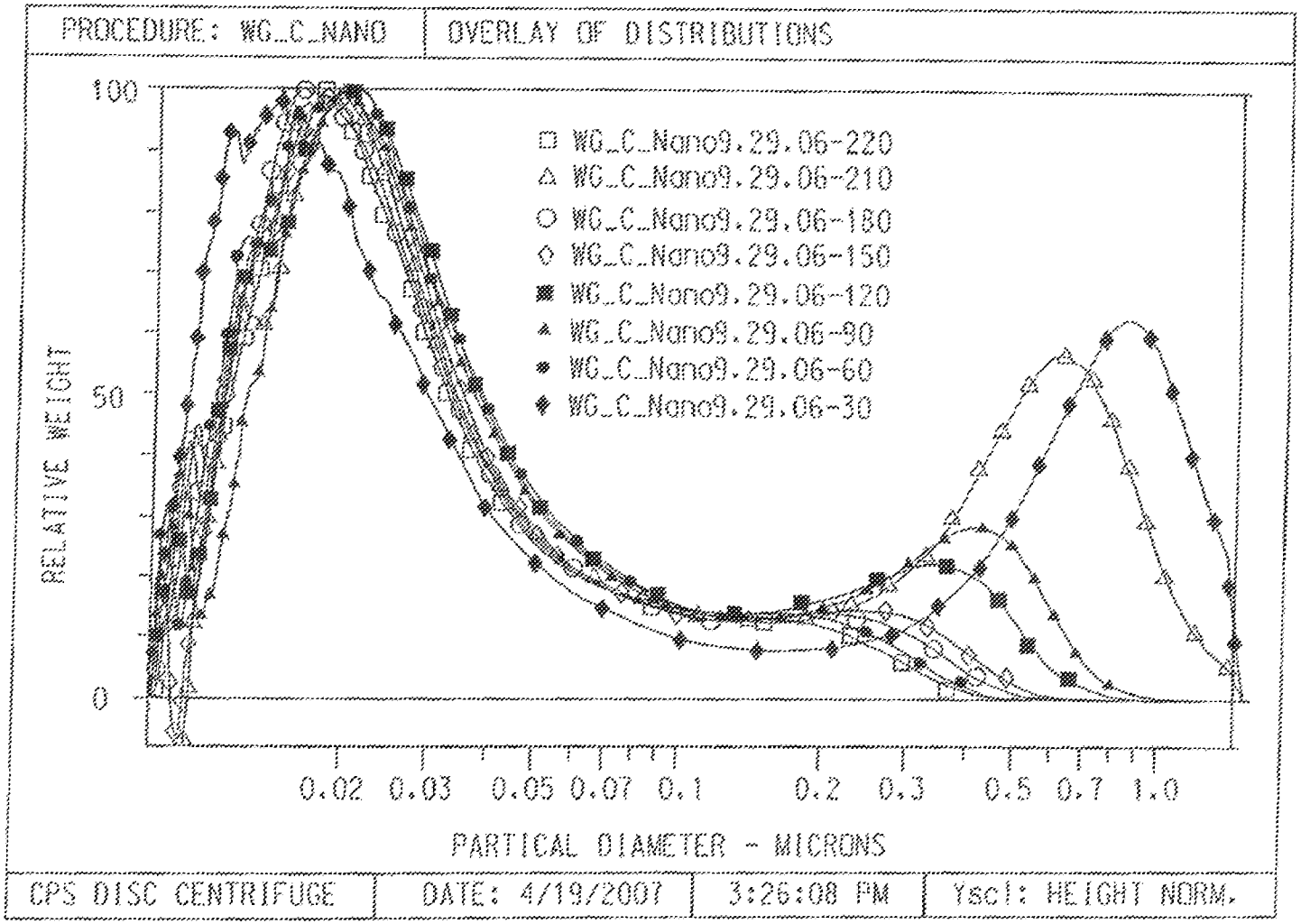
FIG. 10 is a chart/graph illustrating size reduction over a mill cycle time of a product produced according to the present invention.

Similar results when using coal particles are illustrated in Table 2. In particular, Table 2 illustrates the particle size diameter of this coal material over a specified process cycle time. The graphical results are illustrated in FIG. 10.

TABLE 2

DISAGGREGATION PSD COMPARISON
WG-C-NANO

| Product Designation | | | Statistics (micron) | | | Particle Distribution (micron) | | | | | | | | |
|---|---|---|---|---|---|---|---|---|---|---|---|---|---|---|
| Size | ID | Cycle Time | Mean | Std Dev | Mean:Median Ratio | <1% | <5% | <10% | <25% | <50% | <75% | <90% | <95% | <99% |
| WG-C-NANO | Water Soluble | 30 min | 0.293 | 0.3931 | 6.9596199 | 1.3017 | 1.1185 | 0.9631 | 0.5884 | 0.0421 | 0.0224 | 0.0168 | 0.0152 | 0.0133 |
| WG-C-NANO | Water Soluble | 60 min | 0.228 | 0.3054 | 4.7302904 | 1.1382 | 0.8737 | 0.7226 | 0.4055 | 0.0482 | 0.0270 | 0.0201 | 0.0178 | 0.0155 |

TABLE 2-continued

DISAGGREGATION PSD COMPARISON
WG-C-NANO

| Product Designation | | | Statistics (micron) | | | Particle Distribution (micron) | | | | | | | | |
|---|---|---|---|---|---|---|---|---|---|---|---|---|---|---|
| | | Cycle | | | Mean:Median | | | | | | | | | |
| Size | ID | Time | Mean | Std Dev | Ratio | <1% | <5% | <10% | <25% | <50% | <75% | <90% | <95% | <99% |
| WG-C-NANO | Water Soluble | 90 min | 0.1164 | 0.1656 | 3.0077519 | 0.6911 | 0.5107 | 0.3949 | 0.1041 | 0.0387 | 0.0257 | 0.0197 | 0.0170 | 0.0133 |
| WG-C-NANO | Water Soluble | 120 min | 0.0929 | 0.1334 | 2.5734072 | 0.5891 | 0.4154 | 0.2941 | 0.0780 | 0.0361 | 0.0243 | 0.0184 | 0.0164 | 0.0134 |
| WG-C-NANO | Water Soluble | 150 min | 0.0701 | 0.0939 | 2.0801186 | 0.4537 | 0.2943 | 0.1870 | 0.0611 | 0.0337 | 0.0239 | 0.0185 | 0.0167 | 0.0143 |
| WG-C-NANO | Water Soluble | 180 min | 0.0623 | 0.0813 | 1.9840764 | 0.4013 | 0.2544 | 0.1578 | 0.0559 | 0.0314 | 0.0222 | 0.0177 | 0.0155 | 0.0135 |
| WG-C-NANO | Water Soluble | 210 min | 0.0575 | 0.0701 | 1.8312101 | 0.3503 | 0.2181 | 0.1370 | 0.0542 | 0.0314 | 0.0224 | 0.0175 | 0.0157 | 0.0129 |
| WG-C-NANO | Water Soluble | 220 min | 0.0555 | 0.0655 | 1.7845659 | 0.3298 | 0.2042 | 0.1296 | 0.0533 | 0.0311 | 0.0225 | 0.0177 | 0.0156 | 0.0137 |

After the mixing/wetting process 12 and disaggregation process 14, the resulting product may be either a flocculated end product or a simultaneously-dispersed end product. The final chemistries and physical parameters of the end product will vary according to the application, and must be determined prior to the stabilization process 16 discussed next.

There are various manners of processes that can be used in stabilizing at least a portion of the disaggregated material, which results in the reduction or elimination of specified controlling attractive forces between the particles. In one embodiment, the stabilization process is an ultrasonic liquid processing step, where the disaggregated material is re-circulated, mixed, cooled etc. Specifically, this ultrasonic liquid processing step may be controlled by varying the flow rate, recirculation rate, mixing rate, cooling rate, imparted amplitude, etc.

In general, ultrasonic processing (as the stabilization process 16) utilizes high frequency vibrations (approximately 20,000 cycles per second) to produce intense cavitation in liquids. Cavitation bubbles develop localized energy levels many times greater than energy levels achieved by mechanical mixing or high pressure devices. Typical applications for the liquid processing cell include emulsification, dispersion, extraction, biological cell disruption and acceleration of chemical reactions. Other cavitation applications involve removing entrapped gases, impregnation, cleaning the microscopic contamination from hard to reach areas and the breaking of crystals along their natural lines of cleavage. In general, ultrasonics proves cost effective as a final treatment process for use in applications that cannot be completed satisfactorily using conventional equipment and methods. However, it is envisioned that any method, system or apparatus capable of stabilizing this disaggregated material is contemplated within the context of the present invention.

In one embodiment, a power supply transforms 117 volt line current to high frequency electrical energy at 20 kHz. This energy is fed to a piezoelectric element, referred to as a converter, which changes the electrical energy to 20 kHz mechanical, vibratory energy. These vibrations are coupled to the horn, which transmits the high frequency vibrations into the solution to produce intense cavitation.

Figure 11:
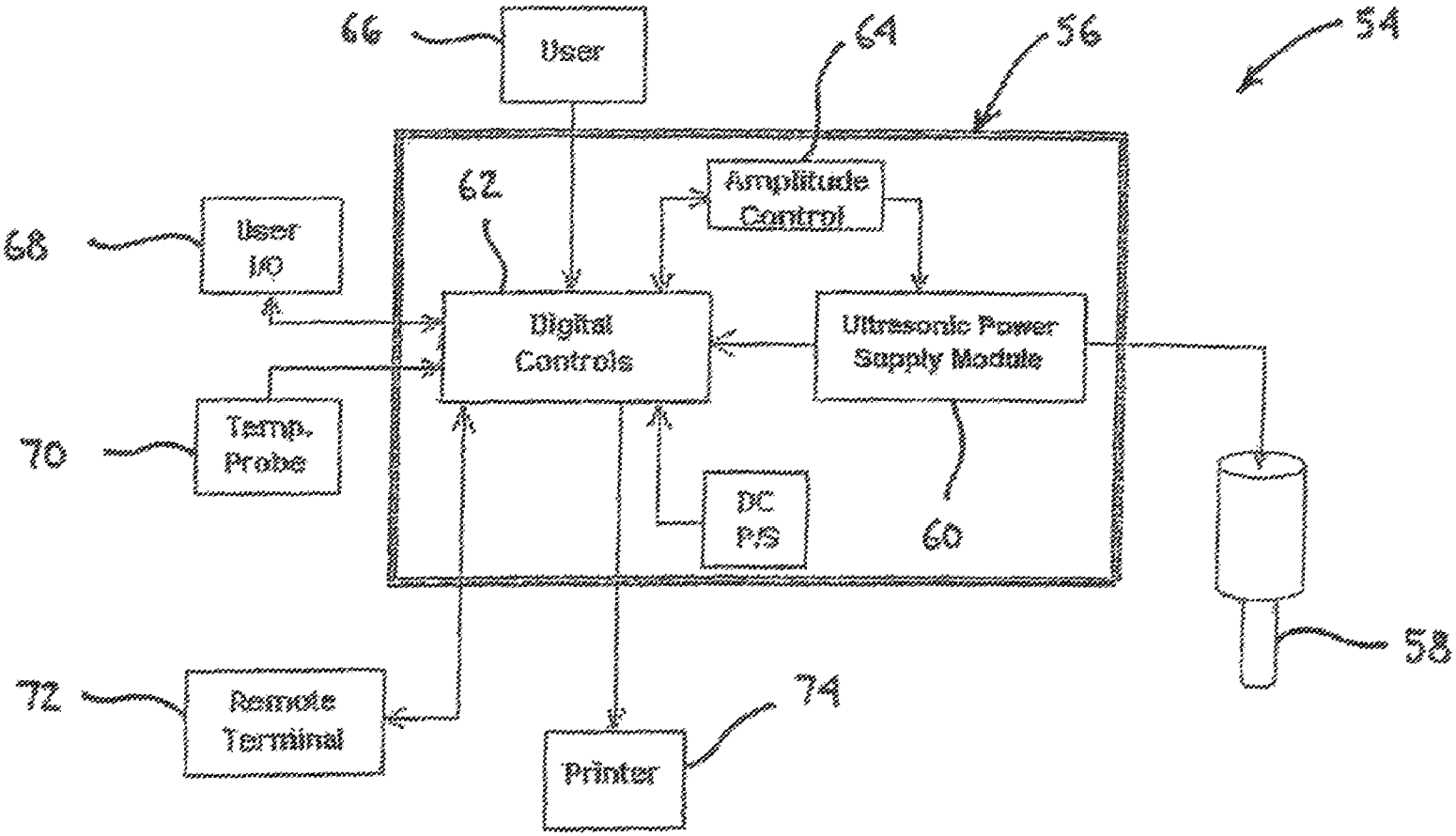
FIG. 11 is a schematic view of a stabilization device for use in connection with the method and system according to the present invention.
Figure 12:
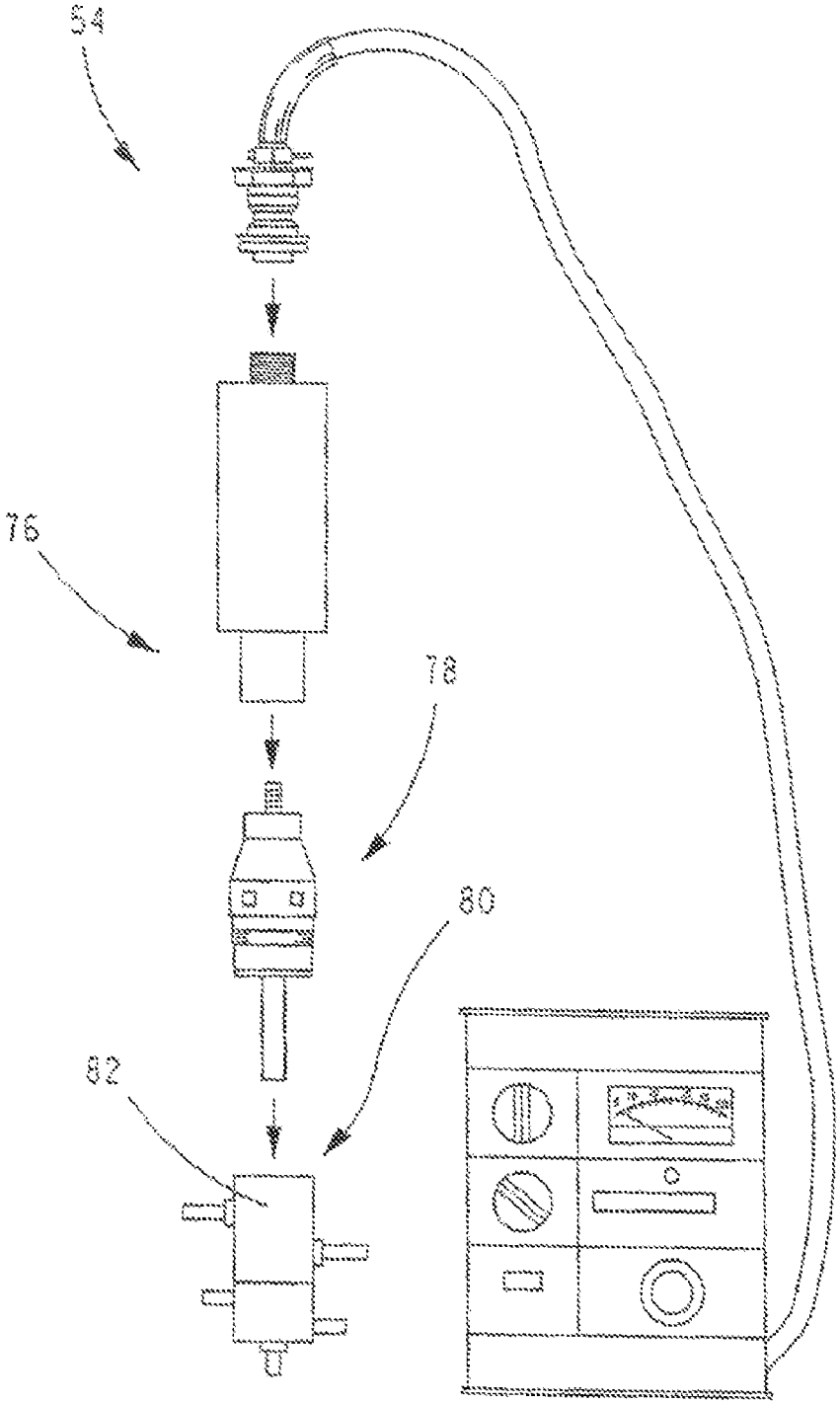
FIG. 12 is a schematic view of another stabilization device for use in connection with the method and system according to the present invention.

Two embodiments of a stabilization apparatus 54 are illustrated in FIGS. 11 and 12. Further, the stabilization apparatus 54 of FIG. 11 is an ultrasonic irradiation apparatus 56. This irradiation apparatus 56 includes a converter and horn 58 driven by a power supply module 60. Using the digital controls 62 and amplitude control 64, some amplitude control is supplied to the power supply module 60. Various entities are capable of providing input to the digital control 62, including a user 66, a user input/output mechanism 68, a temperature probe 70 and a remote terminal 72. In addition, the information provided to and processed by the digital control 62 may be output to a printer 74. In this embodiment, it is this ultrasonic irradiation apparatus 56 that serves to stabilize the wetted, disaggregated particles, thereby reducing or eliminating the specified controlling and attractive forces.

In another embodiment, and as illustrated in FIG. 12, the stabilization apparatus 54 is a sonification apparatus 76. In the embodiment of FIG. 12, the sonification apparatus 76 is a stainless steel, in-line continuous flow cell capable of uniformly processing low-viscosity solutions at rates of 10 GPH or greater. This sonification apparatus 76 may be used to emulsify, disperse and homogenize by pumping a solution through a zone of intense ultrasonic activity. The degree of processing may be controlled by varying the amplitude of an ultrasonic horn 78, as well as the flow rate of the solution through the apparatus 76. Some solutions may require recirculation until the desired results are obtained. A continuous flow attachment 80 may include a cooling jacket 82, through which a suitable cooling liquid could be circulated to retard heat buildup during extended operation. The continuous flow attachment 80 may also be sealed in a closed system to assure sterile conditions and inhibit contamination. The stabilization apparatus illustrated in both FIGS. 11 and 12 represent only two suitable devices capable of supplying ultrasonic energy to the material.

It should be noted that the stabilization process 16 may be implemented in a dilution and/or mixing process (using known mixing or dilution equipment and devices). For example, as opposed to using an ultrasonic stabilization process (as discussed above), the stabilization step may include the use of a device or apparatus that dilutes or mixes the wetted, disaggregated material. In particular, the forces imparted upon the wetted material or disaggregated material during such a mixing or dilution process may be sufficient to effect suspension stabilization. Of course, this is dependent upon the physical and chemical attributes of the material being acted upon, as well as the physical parameters of processing conditions in the system. In addition, sufficient stabilization may occur based upon the required specification of the end product, e.g., particle size distribution and range.

Table 3 illustrates one example of a UDD material after processing by the stabilization apparatus 54. In particular, Table 3 illustrates the mean and peak fineness versus the sonic energy introduced to the wetted, disaggregated material.

TABLE 3

Experiment Date: _____ Operator: Kevin C. Kerns
Overlay:
Experiment Solution: _____
Sonifier Model: 450
Unit Serial Number: BBB06062352A
Converter Serial Number: OBU06042926
Model #: 102C (CE)
Horn Type: Flo-Thru Tip, ½" Tip, #147-037
Parameters, Mode, Preset: Continuous, 240 min.
Amplitude setting (LCD read-out): 95%
Bargraph reading: 60% (12 bars)
Other Set-Up Notes: _____
Total Joules: 1917189 Total mins: 240 J/min 7988.2875

| Supplier/ Cleaned, Uncleaned | Experiment ID # | Sonication/ Sample Mins | Energy J | Energy kWh | PSD Statistics Mean (nm) | PSD Statistics Peak (nm) |
|---|---|---|---|---|---|---|
| UDDN - NC | A-260.SonExp | 0 | 0 | 0 | 33.9 | 35.3 |
| UDDN - NC | A-260.SonExp | 15 | 119824.313 | 0.03328453 | 26.7 | 25.4 |
| UDDN - NC | A-260.SonExp | 30 | 239648.625 | 0.06656906 | 24.6 | 24.3 |
| UDDN - NC | A-260.SonExp | 45 | 359472.938 | 0.09985359 | 23.6 | 23.6 |
| UDDN - NC | A-260.SonExp | 60 | 479297.25 | 0.13313813 | 21.8 | 21.5 |
| UDDN - NC | A-260.SonExp | 75 | 599121.563 | 0.16642266 | 21 | 21.2 |
| UDDN - NC | A-260.SonExp | 90 | 718945.875 | 0.19970719 | 20.6 | 20.8 |
| UDDN - NC | A-260.SonExp | 180 | 1437891.75 | 0.39941438 | 19.9 | 20.4 |
| UDDN - NC | A-260.SonExp | 210 | 1677540.38 | 0.46598344 | 19.9 | 20.7 |
| UDDN - NC | A-260.SonExp | 240 | 1917189 | 0.5325525 | 18.7 | 18.7 |

Figure 13:
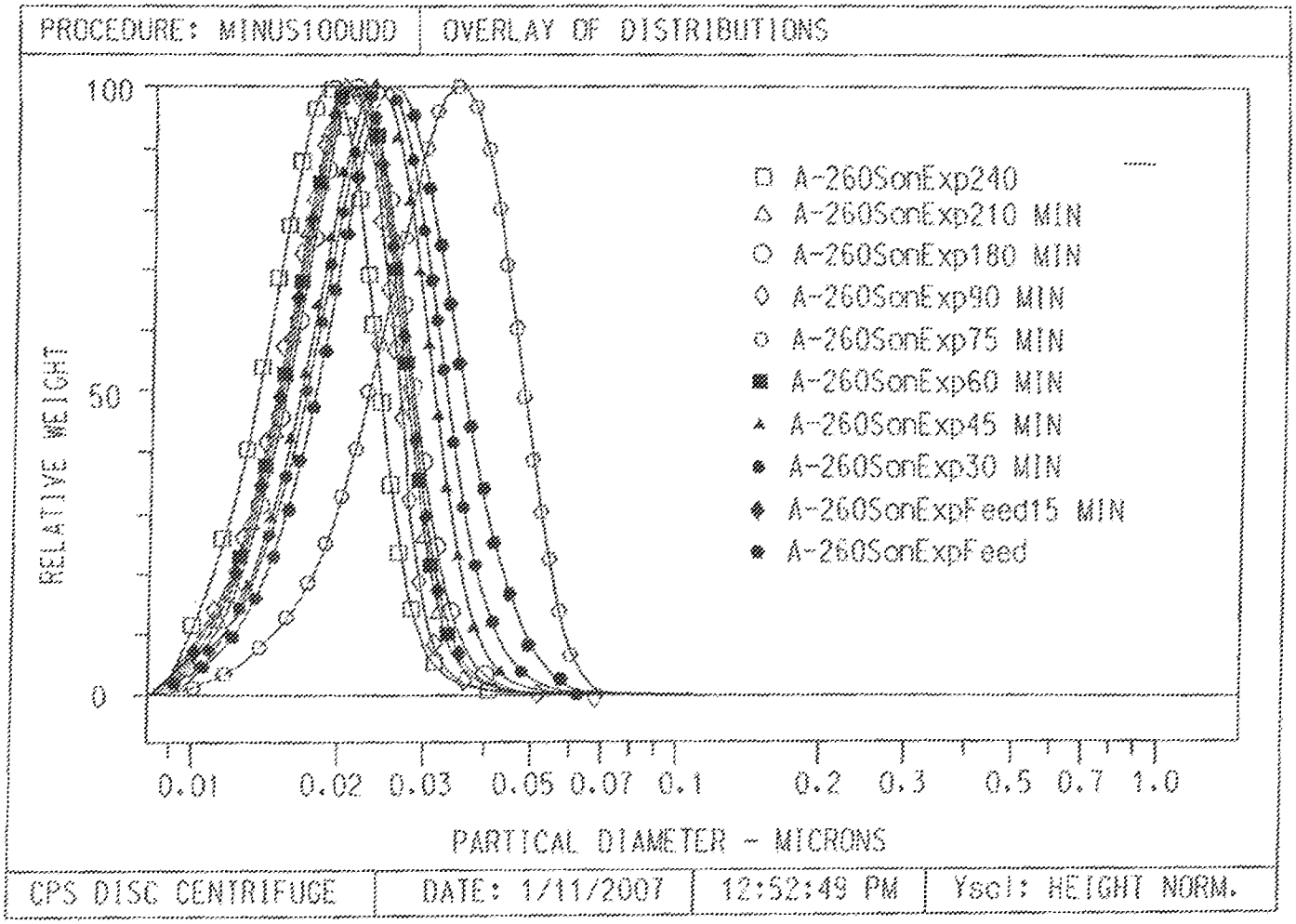
FIG. 13 is a chart/graph illustrating particle size distribution after the use of sonic energy for a product produced according to the present invention.
Figure 14:
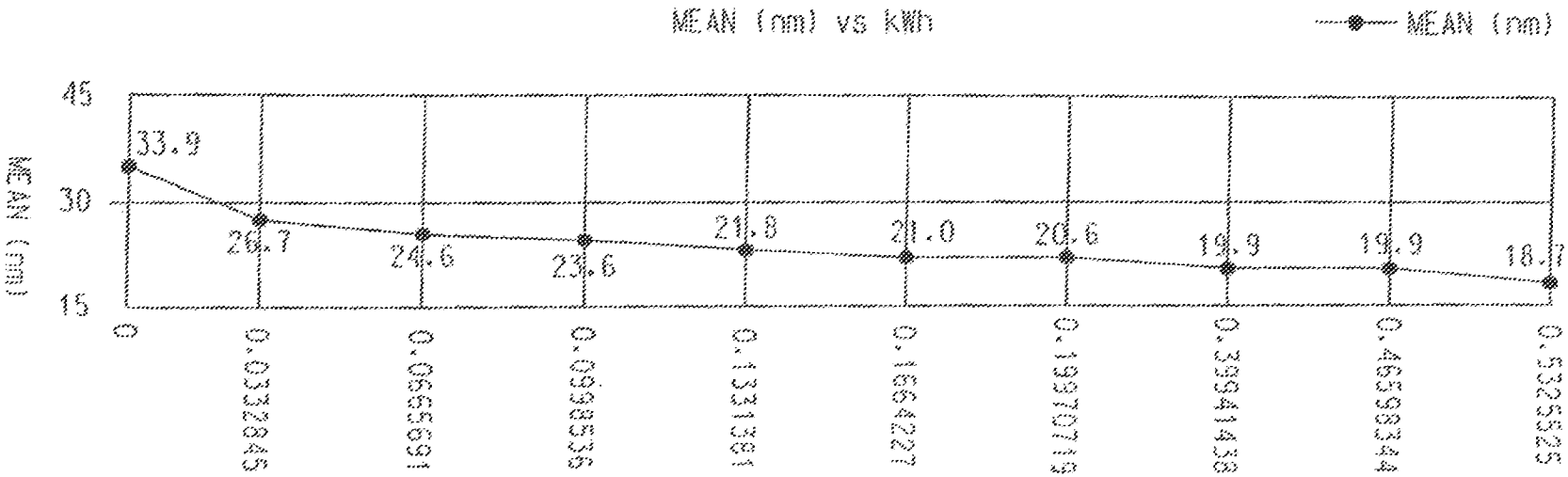
FIG. 14 is a chart/graph illustrating particle mean size versus power for a product produced according to the present invention.

The same example of a UDD material after the stabilization process 16 is illustrated in Table 4, this time demonstrating the particle size distribution of the sonicated material over a set process cycle time. These results are illustrated in graphical form in FIG. 13. Further, a table and graph of the mean size of this sonicated material versus power is illustrated in FIG. 14.

TABLE 4

SONICATION PSD COMPARISON
UDD Experiment A

| Product Designation Size | ID | Batch# | Statistics (micron) Mean | Std Dev | Mean:Median Ratio | Particle Distribution (micron) <1% | <5% | <10% | <25% | <50% | <75% | <90% | <95% | <99% |
|---|---|---|---|---|---|---|---|---|---|---|---|---|---|---|
| UDD | Water Soluble | A-260 - 0 min | .0339 | .0153 | 1.0272727 | .0608 | .0523 | .0479 | .0407 | .0330 | .0260 | .0203 | .0171 | .0125 |
| UDD | Water Soluble | A-260 - 15 min | .0267 | .0147 | 1.0553359 | .0525 | .0427 | .0379 | .0313 | .0253 | .0203 | .0164 | .0143 | .0110 |
| UDD | Water Soluble | A-260 - 30 min | .0246 | .0118 | 1.0379746 | .0469 | .0378 | .0341 | .0287 | .0237 | .0192 | .0155 | .0135 | .0106 |
| UDD | Water Soluble | A-260 - 45 min | .0236 | .0142 | 1.0396475 | .0425 | .0350 | .0318 | .0274 | .0227 | .0187 | .0153 | .0136 | .0112 |
| UDD | Water Soluble | A-260 - 60 min | .0218 | .0156 | 1.0430622 | .0393 | .0321 | .0292 | .0250 | .0209 | .0173 | .0142 | .0126 | .0103 |
| UDD | Water Soluble | A-260 - 75 min | .021 | .0105 | 1.0294117 | .0373 | .0309 | .0282 | .0243 | .0204 | .0168 | .0139 | .0124 | .0101 |
| UDD | Water Soluble | A-260 - 90 min | .0206 | .0087 | 1.0248756 | .0362 | .0302 | .0276 | .0239 | .0201 | .0166 | .0137 | .0122 | .0101 |
| UDD | Water Soluble | A-260 - 180 min | .0199 | .0068 | 1.0205128 | .0338 | .0283 | .0263 | .0230 | .0195 | .0162 | .0135 | .0120 | .0098 |
| UDD | Water Soluble | A-260 - 210 min | .0199 | .0065 | 1.0101522 | .0334 | .0283 | .0263 | .0231 | .0197 | .0163 | .0135 | .0120 | .0099 |
| UDD | Water Soluble | A-260 - 240 min | .0187 | .0138 | 1.0388888 | .0333 | .0268 | .0246 | .0214 | .0180 | .0150 | .0126 | .0113 | .0097 |

As discussed, one optional step is the final separation of the wetted, disaggregated and stabilized material into various specified particle size ranges, distributions or other desired physical characteristics or parameters. For example, this separation process 18 may be a centrifugation step, which is a common process for use in various industries, including biochemistry, cellular and molecular biology, medicine, and now in nano-material development and production. Specifically, centrifugation may now be used in various current research and clinical applications that rely upon the isolation of cells, subcellular organelles, macromolecules and nanometer-sized particles in varying yields.

In general, the separation process 18, in the form of the centrifugation process, uses centrifugal force (g-force) to isolate suspended particles from their surrounding medium on either a batch or continuous flow basis. There are various applications that effectively use centrifugation to produce a final product. For example, centrifugation may be used in connection with the sedimentation of cells and viruses, separation of subcellular organelles, isolation of macromolecules, such as DNA, RNA, proteins, lipids, as well as the production of particles composed of carbon and other elements, usually in the form of oxides.

As known, many particles or cells in a liquid suspension, given time, will eventually settle at the bottom of a container due to gravity. However, the length of time required for such separations is impractical. Other particles, extremely small in size, such as particle sizes targeted for this process, will not separate at all in solution, unless subjected to high centrifugal force. When a suspended solution is rotated at a certain speed (or revolutions per minute), centrifugal force causes the particles to move radially away from the axis of rotation. The force of the particles (compared to gravity) is called relative centrifugal force (RCF). For example, a RCF of 500×g indicates that the centrifugal force applied is 500 times greater than Earth's gravitation force.

There are various types of centrifugal separation processes. For example, one separation process 18 may be differential centrifugation. In this process, separate is achieved primarily based upon the size of the particles in differential centrifugation. This type of separation is commonly used in simple pelleting. During centrifugation, larger particles sediment faster than smaller ones, and this provides the basis for obtaining crude fractions by differential centrifugation.

Another type of centrifugation is referred to as isopycnic or density-gradient centrifugation. Density gradient centrifugation is one preferred method to purify subcellular organelles and macromolecules. Density gradients can be generated by placing layer after layer of gradient media, such as sucrose, in a tube with the heaviest layer at the bottom and the lightest layer at the top (in either a discontinuous or continuous mode). The cell fraction to be separated is placed on the top of the layer and centrifuged. Density gradient separation can be classified into two categories, including rate-zonal (size) separation and isopycnic (density) separation.

Rate-zonal separation takes advantage of particle size and mass, instead of particle density, for sedimentation. For instance, UNCD, including similar materials and coal particle classes, all have very similar densities, but different masses. Thus, separation based upon mass separate the different classes, whereas separation based upon density will not be able to resolve these classes. Certain types of rotors are more applicable for this type of separation and others.

Figure 15:
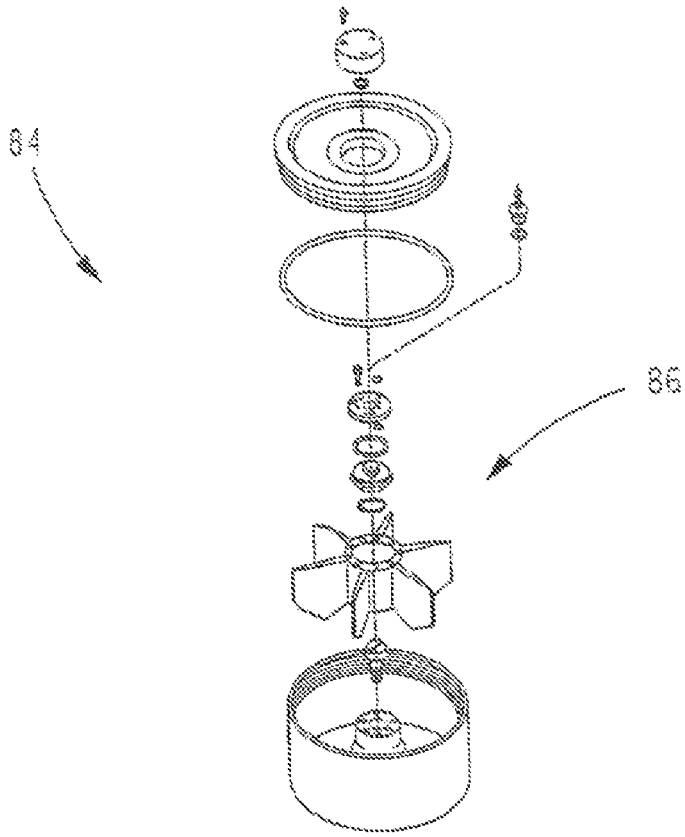
FIG. 15 is a perspective view of a centrifugation device for use in connection with the method and system according to the present invention.
Figure 16:
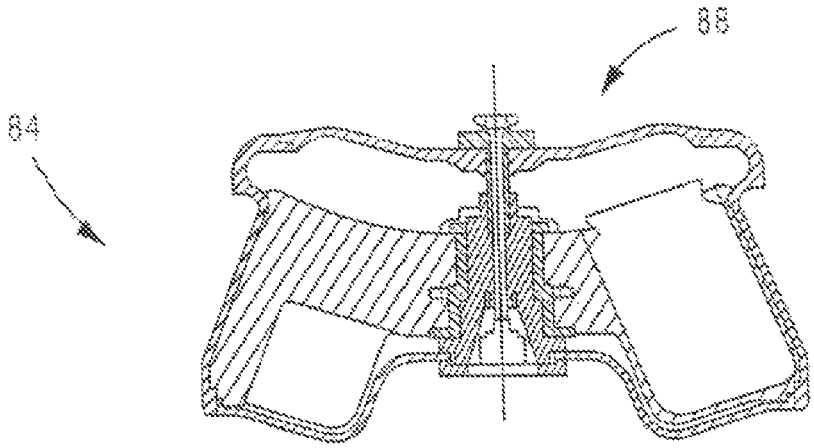
FIG. 16 is a sectional view of a further centrifugation device for use in connection with the method and system according to the present invention.

When using isopycnic separation, a particle of a particular density will sink during centrifugation until a position is reached where the density of the surrounding solution is exactly the same as the density of the particle. Once this quasi-equilibrium is reached, the length of centrifugation does not have any influence upon the migration of the particle. Coal is made up of a variety of macerals or carbon sources, and includes dissimilar corresponding densities. A variety of gradient media can be used for isopycnic separations. Two embodiments of a centrifugation apparatus 84 are illustrated in FIGS. 15 and 16. In particular, FIG. 15 illustrates a continuous flow of rotor assembly 86, and FIG. 16 illustrates a fixed rotor assembly 88 for use in batch processing.

Figure 17:
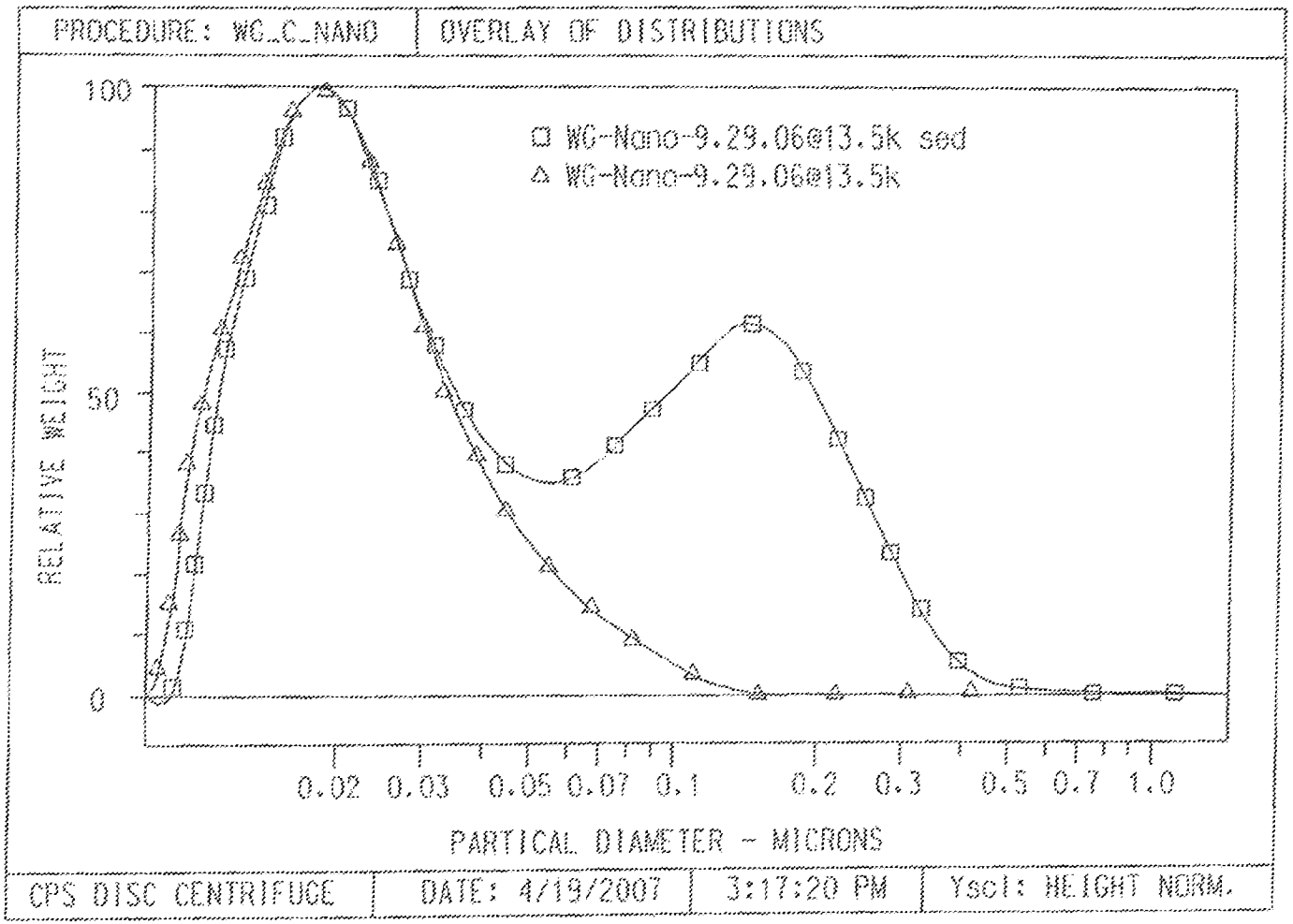
FIG. 17 is a chart/graph illustrating resultant suspension and sediment removal of a product produced according to the present invention.
Figure 18:
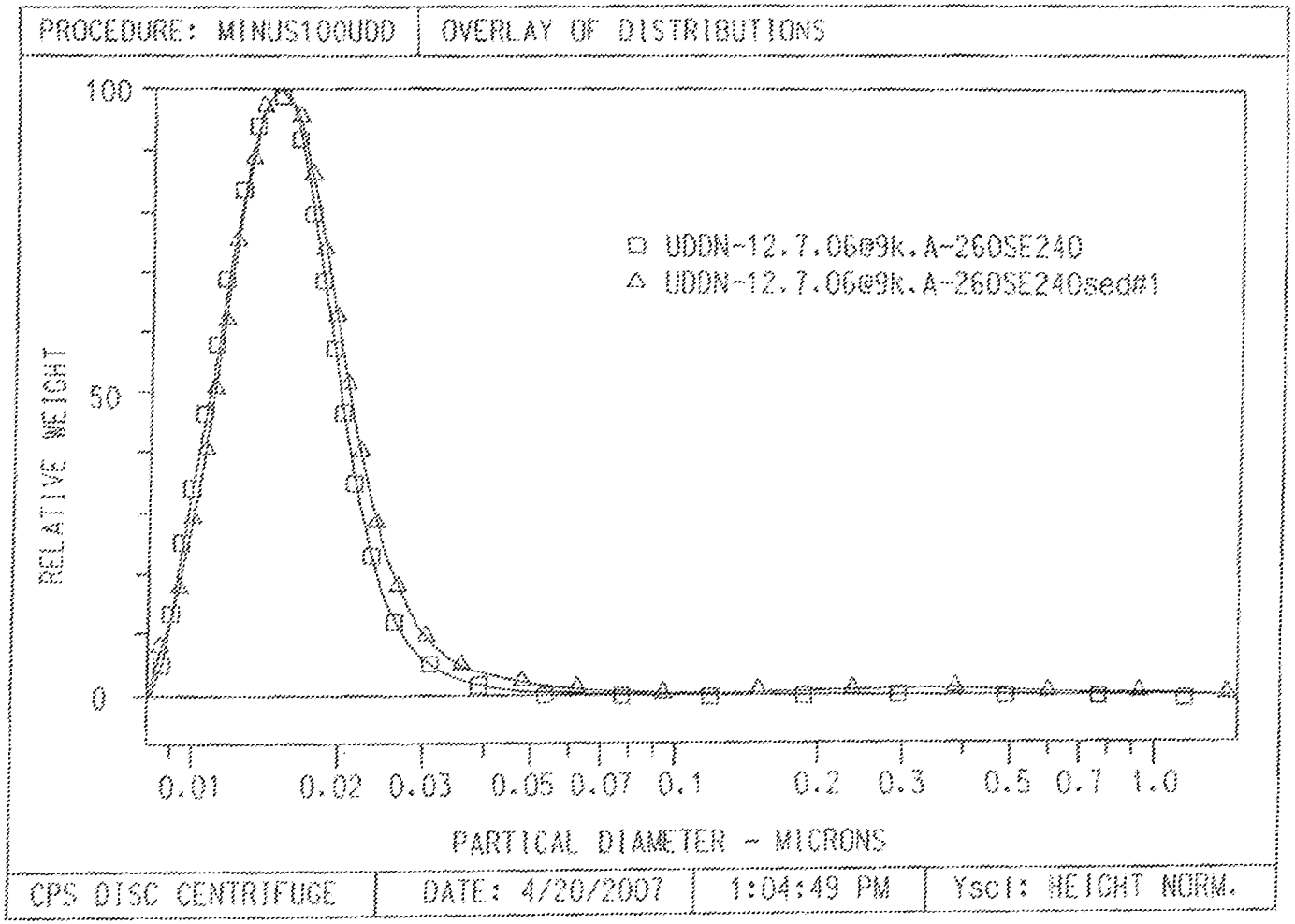
FIG. 18 is a chart/graph illustrating resultant suspension and sediment removal of a product produced according to the present invention.

After the separation process 18, the resulting product is a tailored product useful in a specialized application. Table 5 illustrates a coal material after this separation process 18. Table 6 represents a UDD material after the separation process 18. Both Tables 5 and 6 illustrate a particle size distribution comparison of the resultant suspension and the sediment removed from the original sample. The graphical representation of the "coal" comparison is illustrated in FIG. 17, and the graphical representation of the "UDD" comparison is illustrated in FIG. 18.

TABLE 5

CENTRIFUGATION PSD COMPARISON
WG-C-NANO

| Product Designation | | | Statistics (micron) | | | Particle Distribution (micron) | | | | | | | | |
|---|---|---|---|---|---|---|---|---|---|---|---|---|---|---|
| | | | | | Mean:Median | | | | | | | | | |
| Size | ID | Batch# | Mean | Std Dev | Ratio | <1% | <5% | <10% | <25% | <50% | <75% | <90% | <95% | <99% |
| WG-C-NANO | Water Soluble | 9.29.06@ 13.5 k | .0345 | .0224 | 1.2234042 | .1148 | .0771 | .0599 | .0403 | .0282 | .0210 | .0170 | .0154 | .0138 |
| WG-C-NANO | Water Soluble | 9.29.06@ 13.5 k sed | .0927 | .0901 | 1.8918367 | .3789 | .2736 | .2225 | .1409 | .0490 | .0265 | .0200 | .0178 | .0155 |

TABLE 6

CENTRIFUGATION PSD COMPARISON
UDD

| Product Designation | | | Statistics (micron) | | | Particle Distribution (micron) | | | | | | | | |
|---|---|---|---|---|---|---|---|---|---|---|---|---|---|---|
| | | | | Std | Mean:Median | | | | | | | | | |
| Size | ID | Batch# | Mean | Dev | Ratio | <1% | <5% | <10% | <25% | <50% | <75% | <90% | <95% | <99% |
| UDD | Water Soluble | UDD 12.7.06@9 k | 0.0158 | 0.0092 | 1.0675675 | 0.0341 | 0.0244 | 0.0214 | 0.0177 | 0.0148 | 0.0124 | 0.0108 | 0.0100 | 0.0090 |
| UDD | Water Soluble | UDD 12.7.06@9 k sed | 0.0231 | 0.0549 | 1.4903225 | 0.2888 | 0.0318 | 0.0246 | 0.0191 | 0.0155 | 0.0128 | 0.0110 | 0.0102 | 0.0089 |

In a further aspect of the present invention, the final material may be analyzed. Specifically, this separated material may be analyzed for the presence of a parameter, a specified parameter, a characteristic, a specified characteristic, a physical parameter, a specified physical parameter, a chemical parameter, a specified chemical parameter, particle size, particle size distribution, etc. Further, this analysis may be implemented or performed using a disk centrifuge photo, sedimentometer, a transmission electron microscope, etc.

In one embodiment, the resultant material is analyzed and/or verified using a disc centrifuge photo sedimentometer, which provides high resolution and accurate results, even with non-ideal samples that completely mislead other particle sizing methods. Even very narrow peaks that differ by as little as 3% can be completely separated, while narrow peaks that differ by as little as 2% can be partly separated. Accordingly, the disc centrifuge photo sedimentometer may be particularly useful in analyzing and verifying the final results prior to provision to the end user. As is known, all analyses are run against a known calibration standard, such that high accuracy is assured. Calibration may be either external (calibration standard injected before the unknown) or internal (calibration standard mixed with the unknown). Typical precision of reported sizes with an external standard is about +/−0.5% (95% confidence), and better than +/−0.25% with an internal standard. Replicate runs of the same sample produced virtually duplicate results in all cases.

Further, when using a disc centrifuge photo sedimentometer, even at $10^6$ gram active sample weight, the data provided by this device provides an accurate particle size distribution. The lower detection limit for narrow samples is well below $10^8$ gram, such that even trace quantities of many kinds of particles can be detected. This high sensitivity allows accurate analysis of microgram samples on a routine basis.

Another method of analyzing the resultant product is the use of a transmission electron microscope. Transmission electronmicroscopy (TEM) is an imaging technique whereby a beam of electrons is transmitted through a specimen, then an image is formed, magnified and directed to appear either on a fluorescent screen or a layer of photographic film, or to be directed by a sensor such as a CCD camera. Another type of TEM is the scanning transmission electronmicroscope (STEM), where the beam can be rastered across the sample to form the image. In analytical TEMs, the elemental composition of the specimen can be determined by analyzing its X-ray spectrum or the energy-loss spectrum of the transmitted electrons. Modern research TEMs may include aberration correctors to reduce the amount of distortion in the image, allowing information on features on the scale of 0.1 nm to be obtained, and resolutions down to 0.08 nm have been demonstrated. Monochromators may also be used which reduce the energy spread of the incident electron beam to less than 0.15 eV.

In this manner, a useful and refined material can be provided to the end user for use in specialty applications. The mixing/wetting process 12 is used to wet the material and otherwise transform the solid system to a liquid system, and the disaggregation process 14 is used to separate the larger clusters into smaller clusters and/or discrete particles. The stabilization process 16 is used to overcome or reduce the attractive forces between the resultant small clusters or discrete particles. Finally, the optional separation process 18 is used to provide a specifically-tailored material, such as a material exhibiting a very specific particle size distribution or range. Therefore, the present invention provides a method, system and apparatus that obtains this clustered or agglomerated material and provides a refined and usable end product that meets a specific need.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A method of separating at least one cluster of a plurality of clustered particles of a specified material, comprising:

(a) initiating the wetting of at least a portion of the plurality of clustered particles;

(b) disaggregating at least a portion of the wetted plurality of clustered particles into a disaggregated material comprising a plurality of smaller clusters, discrete particles or any combination thereof by applying at least one selected from the group consisting of: shearing forces, milling forces, agitating forces, impacting forces, or any combination thereof, to at least the portion of the wetted plurality of clustered particles to diminish the size of the wetted plurality of clustered particles and expose particle surfaces containing unwanted liquids and/or gases, thereby producing the disaggregated material; and (c) stabilizing at least a portion of the disaggregated material by reducing or eliminating specified controlling attractive forces.

2. The method of claim 1, further comprising distributing the clustered particles in a liquid system formed of at least one liquid material.

3. The method of claim 2, wherein the liquid material comprises a base solvent, water, oil, a wetting agent, a dispersant agent, a material of dissolved solids, a hyper-dispersant material, a synergistic material, a polar material, a non-polar material or any combination thereof.

4. The method of claim 1, further comprising mixing the plurality of clustered particles in a mixing process.

5. The method of claim 4, wherein the mixing process is vacuum mixing, an agitation process or any combination thereof.

6. The method of claim 4, wherein the mixing step comprises mixing the plurality of clustered particles during the initiating step (a), the disaggregating step (b), the stabilizing step (c) or any combination thereof.

7. The method of claim 1, wherein the disaggregating step (b) is implemented using a high-energy agitator bead mill apparatus.

8. The method of claim 1, wherein the stabilizing step (c) comprises an ultrasonic liquid processing step, dilution step, mixing step or any combination thereof.

9. The method of claim 8, wherein, during the stabilizing step (c), the disaggregated material is re-circulated, mixed, cooled, processed in a sealed area or any combination thereof.

10. The method of claim 8, wherein the ultrasonic liquid processing step is controlled by varying flow rate, recirculation rate, mixing rate, cooling rate, imparted amplitude or any combination thereof.

11. The method of claim 8, wherein the ultrasonic liquid processing step is implemented using a continuous flow/recirculation ultrasonic apparatus, an ultrasonic irradiation apparatus or any combination thereof.

12. The method of claim 1, further comprising separating at least a portion of the wetted, disaggregated and stabilized material into at least one specified particle size range.

13. The method of claim 12, wherein the separating step is a centrifugal separation process.

14. The method of claim 13, wherein the centrifugal process is a differential centrifugation process, a density gradient centrifugation process, a rate-zonal separation process, an isopycnic separation process or any combination thereof.

15. The method of claim 12, further comprising analyzing at least a portion of the separated material.

16. The method of claim 15, wherein the separated material is analyzed for the presence of a parameter, a specified parameter, a characteristic, a specified characteristic, a physical parameter, a specified physical parameter, a chemical parameter, a specified chemical parameter, particle size, particle size distribution or any combination thereof.

17. The method of claim 15, wherein the analysis step is implemented using a disc centrifuge photo sedimentometer, a transmission electron microscope or any combination thereof.

18. The method of claim 1, further comprising analyzing the wetted, disaggregated and stabilized material.

19. The method of claim 1, wherein the specified material is a powdered material, an oxide, a single-metal oxide, complex-metal oxide, a coated particle, ultra-dispersed diamond, an aggregated material, an agglomerated material, a flocculated material, anthracite, coal, a micrometer-sized material, a nanometer-sized material or any combination thereof.

20. A system for separating at least one cluster of a plurality of clustered particles of a specified material, comprising:

means for initiating the wetting of at least a portion of the plurality of clustered particles;

means for disaggregating at least a portion of the wetted plurality of clustered particles into a disaggregated material comprising a plurality of smaller clusters, discrete particles or any combination thereof by applying at least one selected from the group consisting of: shearing forces, milling forces, agitating forces, impacting forces, or any combination thereof, to at least the portion of the wetted plurality of clustered particles to diminish the size of the wetted plurality of clustered particles and expose particle surfaces containing unwanted liquids and/or gases, thereby producing the disaggregated material; and means for stabilizing at least a portion of the disaggregated material by reducing, eliminating or replacing specified controlling attractive forces.

21. An apparatus for separating at least one cluster of a plurality of clustered particles of a specified material, comprising:

a mixing device configured to receive and mix the specified material and at least one liquid material, thereby providing a mixed material comprising a plurality of at least partially wetted, clustered particles;

a disaggregation device configured to receive and disaggregate at least a portion of the mixed material, thereby providing a disaggregated material, the disaggregation device comprising a grinding chamber configured to circulate the mixed material directly into a bed of grinding media, thereby diminishing the size of the mixed material and exposing particle surfaces containing unwanted liquids and/or gases; and a stabilization device configured to receive and stabilize at least a portion of the disaggregated material.

22. The apparatus of claim 21, wherein the mixing device is a vacuum mixer, a batch agitation tank or any combination thereof.

23. The apparatus of claim 21, wherein the disaggregation device is a high-energy agitator bead mill.

24. The apparatus of claim 21, wherein the stabilization device is a continuous flow/recirculation ultrasonic apparatus, an ultrasonic irradiation apparatus, a mixing apparatus or any combination thereof.

* * * * *